US007946265B2

(12) United States Patent
Hattori

(10) Patent No.: US 7,946,265 B2
(45) Date of Patent: May 24, 2011

(54) VALVE TIMING ADJUSTER

(75) Inventor: Isao Hattori, Gifu (JP)

(73) Assignee: Denso Corporation, Kariya (JP)

( * ) Notice: Subject to any disclaimer, the term of this patent is extended or adjusted under 35 U.S.C. 154(b) by 508 days.

(21) Appl. No.: 12/170,805

(22) Filed: Jul. 10, 2008

(65) Prior Publication Data

US 2009/0020086 A1 Jan. 22, 2009

(30) Foreign Application Priority Data

Jul. 19, 2007 (JP) ..... 2007-188731

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.16, 90.18; 74/1, 2, 160
See application file for complete search history.

(56) References Cited

U.S. PATENT DOCUMENTS

| | | | |
|---|---|---|---|
| 6,039,015 | A | 3/2000 | Sato |
| 6,186,104 | B1 | 2/2001 | Torii et al. |
| 6,332,438 | B1 | 12/2001 | Machida |
| 7,063,058 | B1 | 6/2006 | Armour et al. |
| 7,150,251 | B2 | 12/2006 | Watanabe et al. |
| 2002/0100445 | A1 | 8/2002 | Takenaka et al. |
| 2002/0152977 | A1 | 10/2002 | Eguchi et al. |
| 2004/0221825 | A1 | 11/2004 | Nakajima |
| 2005/0028773 | A1 | 2/2005 | Komaki |
| 2005/0103296 | A1 | 5/2005 | Hirowatari et al. |
| 2005/0115526 | A1 | 6/2005 | Schneider |
| 2005/0252468 | A1 | 11/2005 | Tanaka et al. |
| 2005/0257763 | A1 | 11/2005 | Watanabe et al. |
| 2006/0060161 | A1 | 3/2006 | Watanabe et al. |
| 2007/0227484 | A1 | 10/2007 | Watanabe |

FOREIGN PATENT DOCUMENTS

| | | |
|---|---|---|
| EP | 1365112 | 11/2003 |
| EP | 1589197 | 10/2005 |
| EP | 1703087 | 9/2006 |
| JP | 6-159020 | 6/1994 |
| JP | 6-159026 | 6/1994 |
| JP | 2006-063835 | 3/2006 |

OTHER PUBLICATIONS

Extended European Search Report dated Jun. 11, 2010, issued in counterpart European Application No. 08160498.5-1263.
U.S. Appl. No. 12/170,777, Isao Hattori, filed Jul. 10, 2008, (JP 2007-188730).
Extended European Search Report dated Dec. 2, 2008, issued in counterpart European Application No. 08160496.9.

*Primary Examiner* — Ching Chang
(74) *Attorney, Agent, or Firm* — Nixon & Vanderhye PC

(57) ABSTRACT

A supply control apparatus controls advancing supply, which is supply of working fluid to advancing chambers, and retarding supply, which is supply of the working fluid to retarding chambers. The supply control apparatus alternately and repeatedly executes the advancing supply and the retarding supply in such a manner that a rotational torque, which drives a camshaft, changes at a phase of cycle that is opposite from a phase of cycle of a variable torque, which changes with time and is applied to the camshaft, at time of limiting a phase of the camshaft relative to a crankshaft within a target phase range.

4 Claims, 6 Drawing Sheets

VARIABLE TORQUE

DRIVE CURRENT

ROTATIONAL TORQUE

ENGINE PHASE

VALVE TIMING ADJUSTER

CROSS REFERENCE TO RELATED APPLICATION

This application is based on and incorporates herein by reference Japanese Patent Application No. 2007-188731 filed on Jul. 19, 2007.

BACKGROUND OF THE INVENTION

1. Field of the Invention

The present invention relates to a valve timing adjuster, which adjusts opening and closing timing (hereinafter, simply referred to as valve timing) of at least one of an intake valve and an exhaust valve of an internal combustion engine.

2. Description of Related Art

For example, a previously known valve timing adjuster includes a housing and a vane rotor. The housing serves as a first rotatable body and is rotated together with a drive shaft, and the vane rotor serves as a second rotatable body and is rotated together with a driven shaft. In the valve timing adjuster, advancing chambers and retarding chambers are arranged one after another in the rotational direction. Each of the advancing chambers and the retarding chambers is formed between a corresponding one of shoes of the housing and a corresponding one of vanes of the vane rotor. Working fluid is supplied to the advancing chambers or the retarding chambers to drive the driven shaft relative to the drive shaft in an advancing direction or a retarding direction to adjust the valve timing.

In such a valve timing adjuster, as recited in, for example, Japanese Unexamined Patent Publication No. 2006-63835, a variable torque is applied to the driven shaft in response to the rotation of the internal combustion engine. The variable torque is a torque that periodically varies, i.e., changes in an advancing direction for advancing the driven shaft or in a retarding direction for retarding the driven shaft in response to the rotation of the internal combustion engine. Here, the variable torque is caused by, for example, a spring reaction force of each corresponding valve, which is opened and closed by the driven shaft. In the valve timing adjuster, in which the variable torque is transmitted through the driven shaft, the phase of the driven shaft (hereinafter, referred to as an engine phase) relative to the drive shaft is set when the torques applied to the driven shaft are balanced. Besides the above-described variable torque, these torques also include, for example, a rotational torque, which is generated by supply of the fluid to the advancing chambers and the retarding chambers.

When a solenoid spool valve, which is used to control the supply of the fluid to the advancing chambers and the retarding chambers, is controlled in the manner described in Japanese Unexamined Patent Publication No. 2006-63835, the engine phase can be limited within a target phase range to substantially hold the valve timing. However, in such a case, when the variable torque reaches, for example, its peak torque and thereby becomes large, the advancing chambers or the retarding chambers may possibly be compressed to cause outflow of the working fluid from the advancing chambers or the retarding chambers. This may possibly cause fluctuating movement (repeated forward and backward rotation) of the vane rotor relative to the housing. This kind of the fluctuating movement may make it difficult to keep the engine phase within the target phase range and thereby to appropriately adjust the valve timing, which is appropriate for the internal combustion engine. Also, it may cause generation of the hammering sound caused by hitting movement of the vane rotor against the housing. Thus, such fluctuating movement is not desirable.

SUMMARY OF THE INVENTION

The present invention addresses the above disadvantages. Thus, it is an objective of the present invention to provide a valve timing adjuster, which enables adjustment of valve timing appropriately for an internal combustion engine, and which limits generation of hammering sound.

To achieve the objective of the present invention, there is provided a valve timing adjuster that adjusts opening and closing timing of at least one of an intake valve and an exhaust valve of an internal combustion engine and is placed in a drive force transmission system, which transmits a drive force from a drive shaft of the internal combustion engine to a driven shaft that drives the at least one of the intake valve and the exhaust valve to open and close the same. The valve timing adjuster includes a first rotatable body, a second rotatable body and a supply control means. The first rotatable body is rotated together with the drive shaft. The second rotatable body is rotated together with the driven shaft. The second rotatable body cooperates with the first rotatable body to form an advancing chamber and a retarding chamber, which are arranged one after another in a rotational direction between the first rotatable body and the second rotatable body. The second rotatable body generates a rotational torque that drives the driven shaft in an advancing direction or a retarding direction relative to the drive shaft upon supplying of working fluid to the advancing chamber or the retarding chamber. The supply control means is for controlling advancing supply, which is supply of the working fluid to the advancing chamber, and retarding supply, which is supply of the working fluid to the retarding chamber. The supply control means alternately and repeatedly executes the advancing supply and the retarding supply in such a manner the rotational torque changes at a phase of cycle that is opposite from a phase of cycle of a variable torque, which changes with time and is applied to the driven shaft, at time of limiting a phase of the driven shaft relative to the drive shaft within a target phase range.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
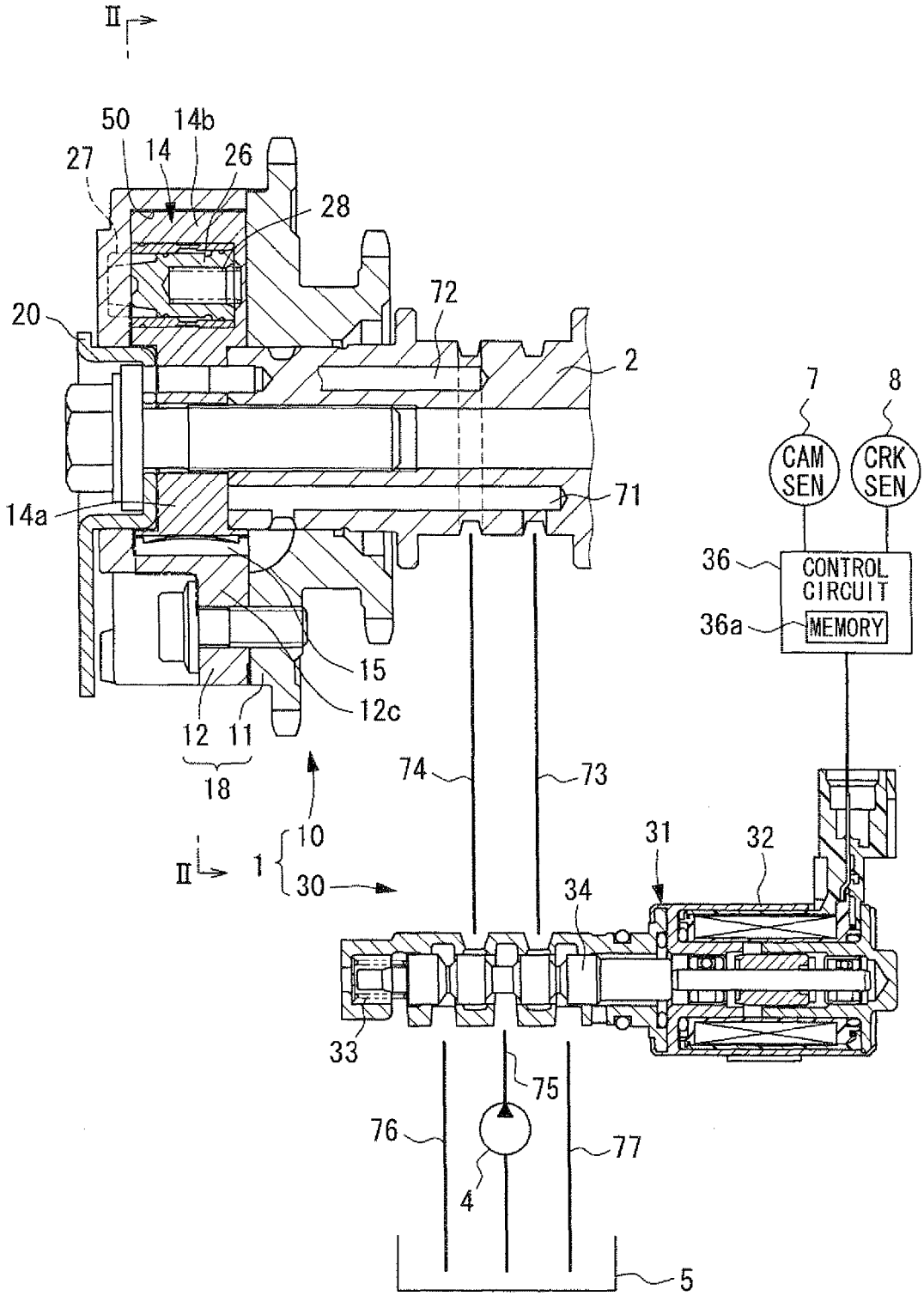
FIG. 1 is a schematic diagram showing a structure of a valve timing adjuster with a drive apparatus viewed along line I-I in FIG. 2 according to a first embodiment of the present invention.

Embodiments of the present invention will be described with reference to the accompanying drawings. In the following respective embodiments, similar components will be indicated by the same reference numerals.

First Embodiment

Figure 2:
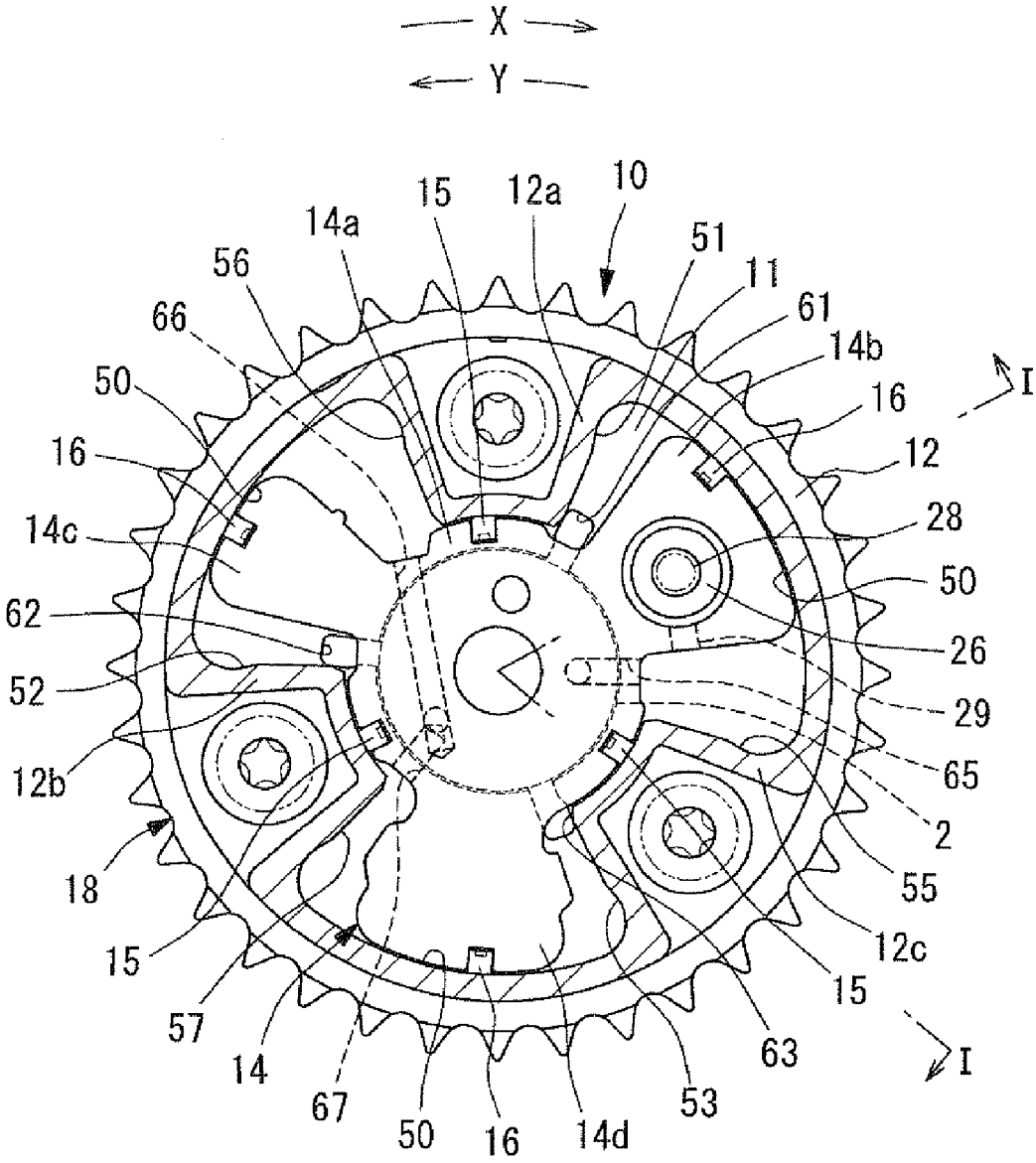
FIG. 2 is a cross sectional view taken along line II-II in FIG. 1.

FIGS. 1 and 2 show a valve timing adjuster 1 of a first embodiment of the present invention implemented in an internal combustion engine of a vehicle. The valve timing adjuster 1 is of a hydraulically controlled type, which uses hydraulic oil as working fluid and which adjusts the valve timing of intake valves. The valve timing adjuster 1 includes a drive apparatus 10 and a control apparatus 30. The drive apparatus 10 is hydraulically driven in a drive force transmission system, which transmits a drive force of an undepicted crankshaft (serving as a drive shaft) of an internal combustion engine to a camshaft 2 (serving as a driven shaft) of the internal combustion engine. The control apparatus 30 serves as a supply control means and controls supply of oil to the drive apparatus 10.

First, the drive apparatus 10 will be described. A housing (serving as a first rotatable body) 18 of the drive apparatus 10 includes a sprocket 11 and a shoe housing 12.

The shoe housing 12 is configured into a cup-shaped cylindrical body having an opening at one axial end and a bottom wall at the other axial end and includes a plurality of shoes 12*a*-12*c*, which are placed at generally equal intervals in the rotational direction. Each shoe 12*a*-12*c* projects radially inward and serves as a partition. A projecting end surface of each shoe 12*a*-12*c* forms an arcuate surface when it is viewed in a direction perpendicular to the plane of FIG. 2. The projecting end surface of each shoe 12*a*-12*c* slidably engages an outer peripheral wall surface of a boss 14*a* of a vane rotor 14. A receiving chamber 50 is formed between each adjacent two of the shoes 12*a*-12*c*, which are adjacent to each other in the rotational direction. Each receiving chamber 50 is defined by lateral surfaces of the corresponding shoes 12*a*-12*c* and an inner peripheral wall surface of the shoe housing 12 and has a fan shape as viewed in the direction perpendicular to the plane of FIG. 2.

The sprocket 11 is formed into a cylindrical body and is coaxially fixed to an opening side of the shoe housing 12 with bolts. The sprocket 11 is connected to the crankshaft through a timing chain (not shown). In this way, the housing 18 is rotated together with the crankshaft when the drive force is transmitted from the crankshaft to the sprocket 11 upon the operation of the internal combustion engine. At this time, the housing 18 is rotated in a clockwise direction in FIG. 2.

The vane rotor 14, which serves as a second rotatable body, is received in the housing 18. Two opposed axial end surfaces of the vane rotor 14 are slidably engaged with an inner surface of the sprocket 11 and an inner bottom surface of the shoe housing 12, respectively. The vane rotor 14 includes the cylindrical boss 14*a* and a plurality of vanes 14*b*-14*d*. A seal member 15 is fitted into a recess of each of engaging portions of an outer peripheral wall surface of the boss 14*a*, to which the shoes 12*a*-12*c* are respectively, slidably engaged. A cylindrical tubular bush 20 is relatively rotatably received at a location radially inward of the bottom portion of the shoe housing 12 and is coaxially engaged with one end portion of the boss 14*a*. The boss 14*a* is fixed together with the bush 20 to the camshaft 2, which is coaxial with the boss 14*a*, with a bolt. Thus, the vane rotor 14 is rotated together with the camshaft 2 and the bush 20 in the clockwise direction in FIG. 2. Furthermore, the vane rotor 14 and the camshaft 2 are rotatable relative to the housing 18. In FIG. 2, a direction of an arrow X indicates an advancing direction (a direction toward an advancing side) of the vane rotor 14 relative to the housing 18, and a direction of an arrow Y indicates a retarding direction (a direction toward a retarding side) of the vane rotor 14 relative to the housing 18.

The vanes 14*b*-14*d*, which are placed one after another at the generally equal intervals in the rotational direction at the boss 14*a*, radially outwardly project from the boss 14*a* and are received in the receiving chambers 50, respectively. A projecting end surface of each vane 14*b*-14*d* forms an arcuate surface as viewed in the direction perpendicular to the plane of FIG. 2 and is slidably engaged with the inner peripheral wall surface of the shoe housing 12. A seal member 16 is fitted into a recess, which is provided in the projecting end surface of each vane 14*b*-14*d*.

Each vane 14*b*-14*d* divides the corresponding receiving chamber 50 to form an advancing chamber and a retarding chamber relative to the housing 18. Specifically, the advancing chamber 51 is formed between the shoe 12*a* and the vane 14*b*, and the advancing chamber 52 is formed between the shoe 12*b* and the vane 14*c*. Furthermore, the advancing chamber 53 is formed between the shoe 12*c* and the vane 14*d*. Also, the retarding chamber 55 is formed between the shoe 12*c* and the vane 14*b*, and the retarding chamber 56 is formed between the shoe 12*a* and the vane 14*c*. Also, the retarding chamber 57 is formed between the shoe 12*b* and the vane 14*d*.

Therefore, when the vane rotor 14 is placed in a most advanced position in the advancing direction X with respect to the housing 18, a volume of each advancing chamber 51-53 is maximized while a volume of each retarding chamber 55-57 is minimized. In contrast, when the vane rotor 14 is placed in a most retarded position in the retarding direction Y with respect to the housing 18, the volume of each retarding chamber 55-57 is maximized while the volume of each advancing chamber 51-53 is minimized.

The advancing chambers 51-53 are communicated with advancing passages 61-63, which are formed in the sprocket 11 and are communicated with an advancing passage 71 formed in the camshaft 2. The retarding chambers 55-57 are communicated with retarding passages 65-67, which are formed in the vane rotor 14, and the retarding passages 65-67 are communicated with a retarding passage 72 formed in the camshaft 2.

A stopper pin 26 is received in the vane 14*b*. When the stopper pin 26 is urged by the restoring force of a compression coil spring 28 and is thereby fitted into an engaging ring 27 at the bottom portion of the shoe housing 12, the vane rotor 14 is arrested in the most retarded position, which is most retarded in the retarding direction Y relative to the housing 18. When the stopper pin 26 receives the pressure of the oil supplied from the retarding chamber 55 through a passage 29 formed in the vane 14*b*, the stopper pin 26 is axially displaced from the engaging ring 27. Therefore, the rotation of the vane rotor 14 relative to the housing 18 is enabled, i.e., is permitted.

Next, the control apparatus 30 will be described. In the control apparatus 30, the advancing passage 73 and the retarding passage 74 are communicated with the advancing passage 71 and the retarding passage 72, respectively, of the camshaft 2.

A switch control valve 31 is communicated with the advancing passage 73, the retarding passage 74, a pump passage 75 and drain passages 76, 77. An oil pump (serving as a fluid supply source) 4 is provided in the pump passage 75. The oil pump 4 draws the oil from the oil tank 5 through an upstream side part of the pump passage 75 and discharges the oil toward the switch control valve 31 through a downstream side part of the pump passage 75. The oil pump 4 of the present embodiment is a mechanical pump that is driven by the crankshaft. The drain passages 76, 77 are provided to enable draining of the oil from the switch control valve 31 toward the oil tank 5.

The switch control valve 31 is a solenoid spool valve that axially drives the spool 34 in response to a balance between the drive force, which is generated by a solenoid drive arrangement 32 upon energization thereof, and a restoring force, which is generated by the return spring 33 in a direction opposite from the direction of the drive force. The switch control valve 31, which is connected with the passages 73-77, switches the communication of the pump passage 75 and the drain passages 76, 77 to the advancing passage 73 and the retarding passage 74.

Figure 3:
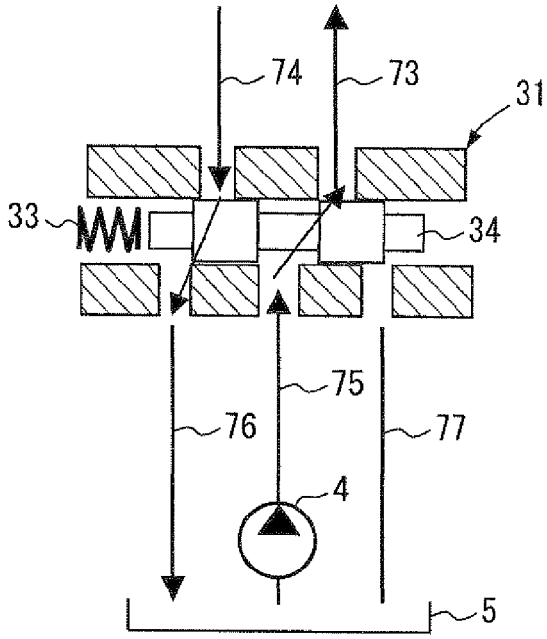
FIG. 3 is a schematic descriptive diagram for describing an operation of a control apparatus of the valve timing adjuster shown in FIG. 1.

Specifically, when the drive current, which is supplied to the solenoid drive arrangement 32, is smaller than a reference value Ib, the advancing passage 73 is communicated with the pump passage 75, so that the oil discharged from the oil pump 4 is supplied to the advancing passage 73 through the pump passage 75, as shown in FIG. 3. At this time, as shown in FIG. 3, the retarding passage 74 is communicated with the drain passage 76, and the oil of the retarding passage 74 is drained to the oil tank 5 through the drain passage 76.

Figure 4:
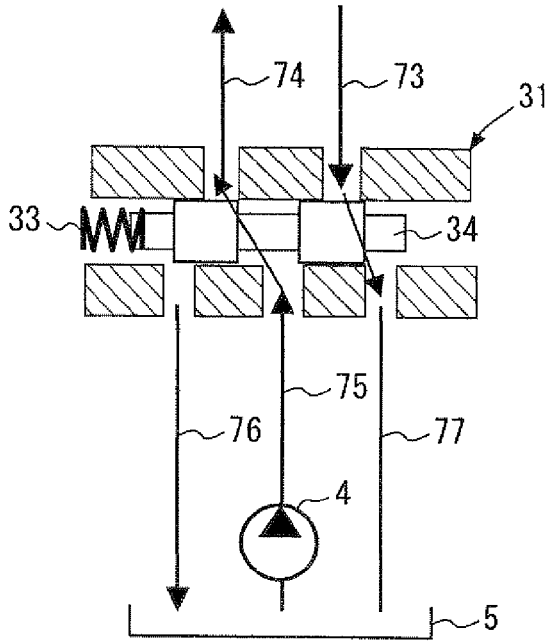
FIG. 4 is a schematic descriptive diagram for describing an operation of the control apparatus of the valve timing adjuster shown in FIG. 1.

When the drive current, which is supplied to the solenoid drive arrangement 32, is larger than the reference value Ib, the retarding passage 74 is communicated with the pump passage 75, so that the oil discharged from the oil pump 4 is supplied to the retarding passage 74 through the pump passage 75, as shown in FIG. 4. At this time, as shown in FIG. 4, the advancing passage 73 is communicated with the drain passage 77, and the oil of the advancing passage 73 is drained to the oil tank 5 through the drain passage 77.

Figure 5:
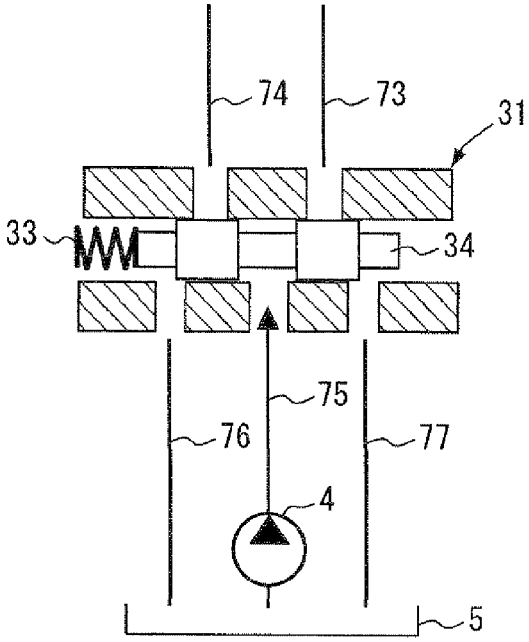
FIG. 5 is a schematic descriptive diagram for describing an operation of the control apparatus of the valve timing adjuster shown in FIG. 1.

When the drive current, which is supplied to the solenoid drive arrangement 32, is equal to the reference value Ib, the communication of each of the advancing passage 73 and the retarding passage 74 to the pump passage 75 and the drain passages 76, 77 is interrupted, as shown in FIG. 5. Therefore, the oil, which is discharged from the oil pump 4, is not supplied to the advancing passage 73 and the retarding passage 74, and the oil in the advancing passage 73 and the oil in the retarding passage 74 remain therein.

A control circuit 36 of the control apparatus 30 shown in FIG. 1 includes a microcomputer, which has a memory 36*a*. The control circuit 36 controls electric power supply to the switch control valve 31 and also controls the operation of the internal combustion engine. Specifically, besides the switch control valve 31, a plurality of sensors, which includes a cam angle sensor 7 and a crank angle sensor 8, is electrically connected to the control circuit 36. The control circuit 36 computes an actual phase and a target phase of the camshaft 2 relative to the crankshaft based on an output of each corresponding sensor. Based on the computed result, the control circuit 36 controls the power supply to the switch control valve 31, i.e., controls the drive current supplied to the switch control valve 31. The cam angle sensor 7 is placed, for example, adjacent to the camshaft 2 to sense a rotational angle of the camshaft 2. The crank angle sensor 8 is placed, for example, adjacent to the crankshaft and senses a rotational angle of the crankshaft.

The drive apparatus 10 and the control apparatus 30 of the valve timing adjuster have been described. Now, the variable torque, which is applied to the drive apparatus 10, will be described.

Figure 6:
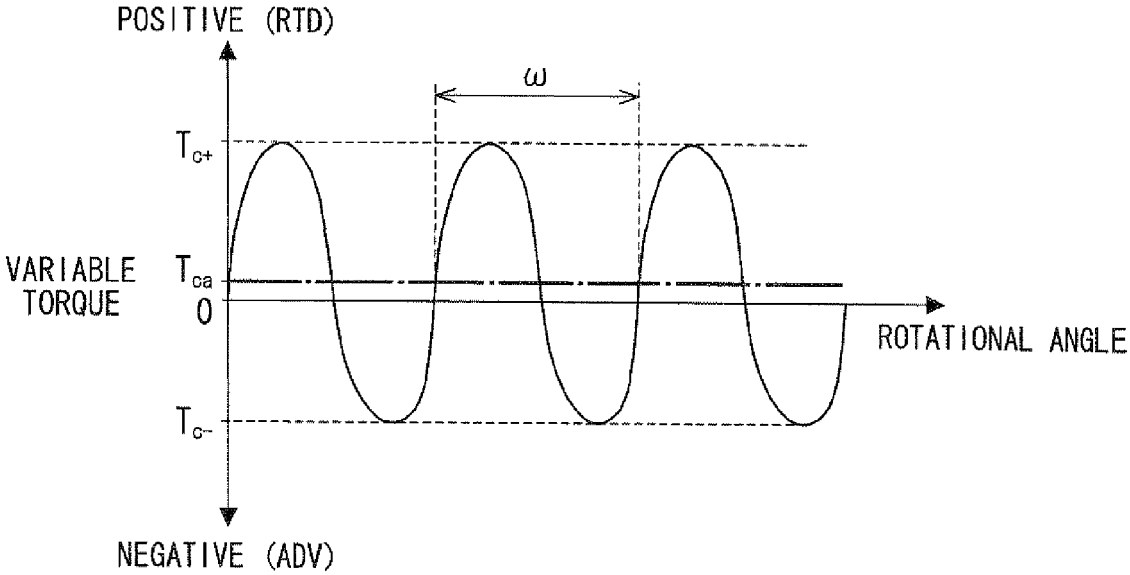
FIG. 6 is a schematic descriptive diagram for describing a variable torque, which acts on the drive apparatus shown in FIG. 1.
Figure 7:
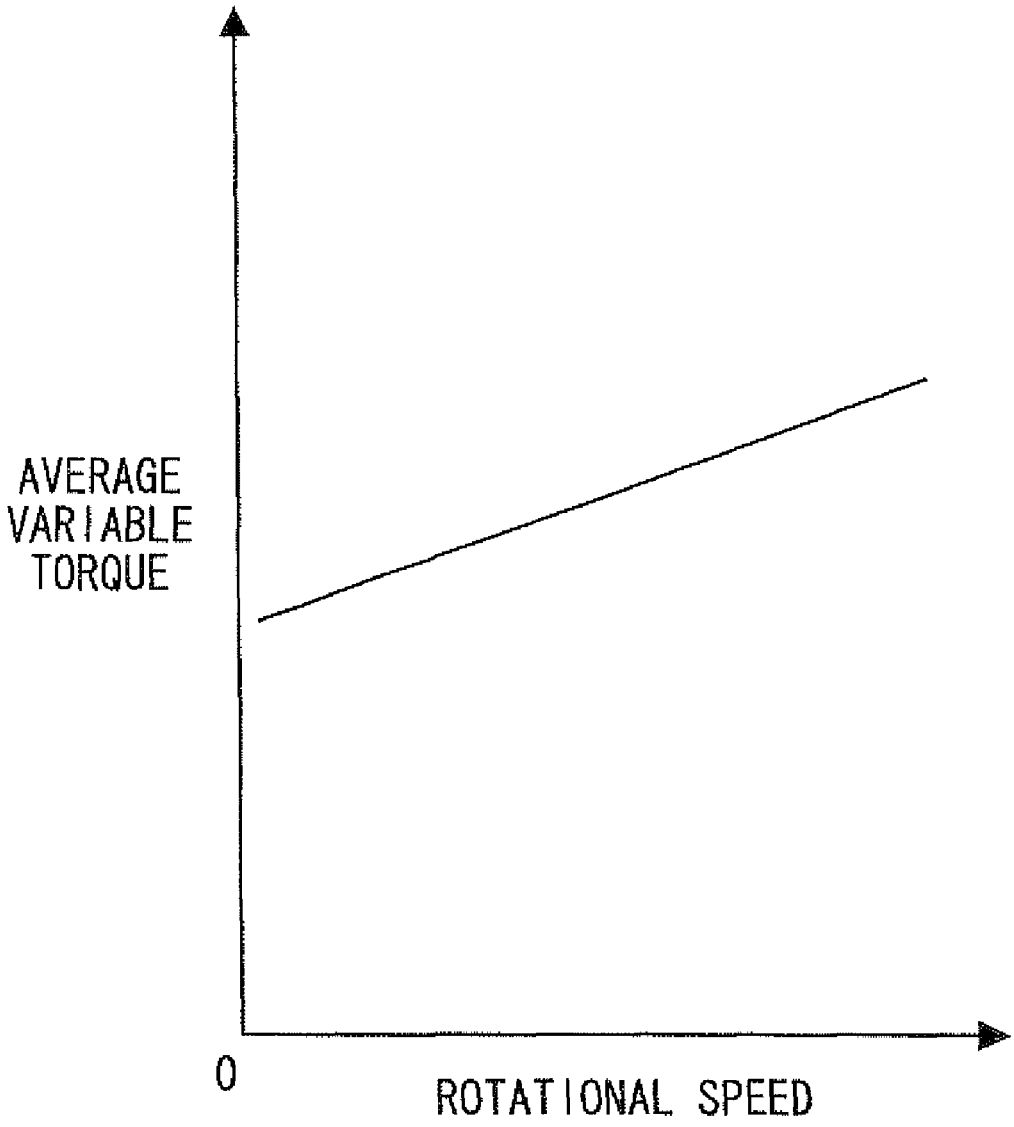
FIG. 7 is a schematic descriptive diagram for describing a variable torque applied to the drive apparatus shown in FIG. 1.

During the operation of the internal combustion engine, the variable torque (i.e., the torque that varies with time) is applied to the camshaft 2 and the vane rotor 14 in response to a spring reaction force from each corresponding intake valve driven to open and close by the camshaft 2. Here, as shown in FIG. 6, the variable torque periodically changes between a positive torque, which acts in a direction for retarding the engine phase of the camshaft 2 relative to the crankshaft, and a negative torque, which acts in a direction for advancing the engine phase. The variable torque of the present invention is such that a peak torque Tc+ of the positive torque is larger than a peak torque Tc− of the negative torque due to the friction between the camshaft 2 and a journal (not shown) for supporting the camshaft 2. Therefore, an average torque (hereinafter, referred to as an average variable torque) Tca of the variable torque is biased on the positive torque side, i.e., on the retarding side Y. Furthermore, as shown in FIG. 7, when the rotational speed (i.e., the number of revolutions per unit time) of the internal combustion engine is increased, the average torque Tca is increased.

Now, the variable torque, which is applied to the drive apparatus 10, will be described. Hereinafter, the characteristic operation of the valve timing adjuster 1 will be described.

In a stop state of the internal combustion engine, the stopper pin 26 is fitted into the engaging ring 27 by the restoring force of the compression coil spring 28. When the internal combustion engine is started from the stop state, the oil pump 4 is driven, and the retarding passage 74 is communicated with the pump passage 75 by controlling the drive current, which is applied from the control circuit 36 to the switch control valve 31, to a value that is larger than the reference value Ib. Then, the oil, which is discharged from the oil pump 4, is supplied to the respective retarding chambers 55-57 through the pump passage 75 and the retarding passages 74, 72, 65-67. Therefore, the stopper pin 26 receives the oil pressure from the retarding chamber 55 through the passage 29, so that the stopper pin 26 is removed, i.e., is dislodged from the engaging ring 27 against the restoring force of the compression coil spring 28 upon increasing the oil pressure, which is received from the retarding chamber 55, to the predetermined value. Therefore, the vane rotor 14 is placed into the rotatable state where the vane rotor 14 is rotatable relative to the housing 18.

Thereafter, the control circuit 36 controls the electric power supply to the switch control valve 31 to change each communicating one of the pump passage 75 and the drain passages 76, 77, which is communicated with the corresponding one of the advancing passage 73 and the retarding passage 74, thereby adjusting the valve timing. Now, the valve timing control operation will be described in detail.

First, the valve timing advancing operation for advancing the valve timing will be described. In the case where the accelerator of the internal combustion engine is in an off state or in the case where a predetermined operational condition, which indicates a low/middle speed high load operational state of the internal combustion engine that requires the output torque, is satisfied, the control circuit 36 controls the drive current supplied to the switch control valve 31 to a value smaller than the reference value Ib. In this way, the advancing passage 73 is communicated with the pump passage 75, and the retarding passage 74 is communicated with the drain passage 76. Therefore, the oil discharged from the oil pump 4 is supplied to the respective advancing chambers 51-53 through the pump passage 75 and the advancing passages 73, 71, 61-63. Furthermore, at this time, the oil in the respective retarding chambers 55-57 is drained to the oil tank 5 through the retarding passages 65-67, 72, 74 and the drain passage 76. In this way, the pressure of the oil is applied to the vanes 14*b*-14*d*, which face the advancing chambers 51-53, respectively, thereby generating the rotational torque Tv, which drives the vane rotor 14 to rotate the same relative to the housing 18 in the advancing direction X. As a result, the engine phase of the camshaft 2 relative to the crankshaft and thereby the valve timing is advanced.

Next, the valve timing retarding operation for retarding the valve timing will be described. In the case where a predetermined operational condition, which indicates a normal operational state where the internal combustion engine is driven with a light load, is satisfied, the control circuit 36 controls the drive current supplied to the switch control valve 31 to a value larger than the reference value Ib. Thereby, the retarding passage 74 is communicated with the pump passage 75, and the advancing passage 73 is communicated with the drain passage 77. Thus, the oil, which is discharged from the oil pump 4, is supplied to the respective retarding chambers 55-57 through the pump passage 75 and the retarding passages 74, 72, 65-67. Furthermore, at this time, the oil in the respective advancing chambers 51-53 is drained to the oil tank 5 through the advancing passages 61-63, 71, 73 and the drain passage 77. In this way, the pressure of the oil is applied to the vanes 14*b*-14*d*, which face the retarding chambers 55-57, respectively, thereby generating the rotational torque Tv, which drives the vane rotor 14 to rotate the same relative to the housing 18 in the retarding direction Y. As a result, the engine phase of the camshaft 2 relative to the crankshaft and thereby the valve timing is retarded.

Next, the valve timing holding operation for substantially holding the valve timing will be described. In the case where a predetermined operational condition, which indicates a stable operational condition of the internal combustion engine, is satisfied as a limiting condition, the control circuit 36 executes an alternately repeating supply operation.

Figure 8A:
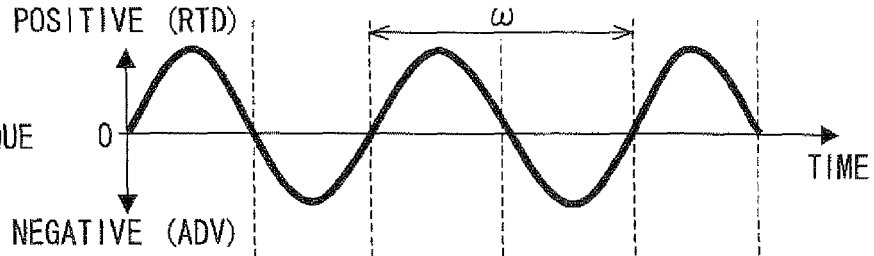
FIGS. 8A to 8D are schematic diagrams for describing the characteristics of the valve timing adjuster of FIG. 1.
Figure 8B:
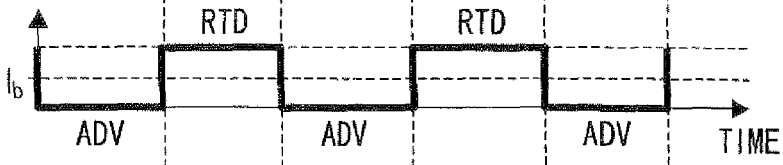

Specifically, in the alternately repeating supply operation, as indicated in FIG. 8B, advancing (ADV) supply and retarding (RTD) supply are alternately repeated. The advancing supply is supply of the oil to the respective advancing chambers 51-53 implemented by controlling the drive current supplied to the switch control valve 31 in the manner similar to that of the advancing operation discussed above. The retarding supply is supply of the oil to the respective retarding chambers 55-57 implemented by controlling the drive current supplied to the switch control valve 31 in the manner similar to that of the retarding operation discussed above. At this time, an actual phase Pr is computed based on the output of the cam angle sensor 7 and the output of the crank angle sensor 8 with respect to the engine phase of the camshaft 2 relative to the crankshaft. Then, the drive current, which is supplied to the switch control valve 31, is adjusted in a manner that limits the actual phase Pr within a predetermined target phase range ΔPt.

Figure 8C:
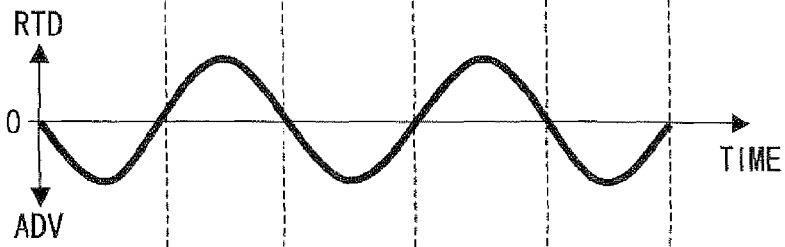

Here, in the alternately repeating supply operation, a period ω of cycle of the change in the variable torque, which corresponds to the current actual rotational speed Nr of the internal combustion engine, is computed based on the correlation information, which indicates the relationship between the rotational speed of the internal combustion engine and the period ω of cycle of the change in the variable torque (see FIG. 6). Then, the advancing supply and the retarding supply are alternately repeated in a manner that causes generation of the rotational torque Tv that periodically changes at the same period of cycle, which is the same as the computed period ω of cycle of the change in the variable torque, and at the opposite phase (advanced or retarded), which is opposite or is revered from the phase of the variable torque, while the rotational torque Tv is kept less than the peak torque Tc+ and the peak torque Tc−, as shown in FIGS. 8A and 8C. The correlation information, which indicates the relationship between the rotational speed of the internal combustion engine and the period ω of cycle of the change in the variable torque, is preset in a form of a map, a table or a mathematical equation according to the specification of the internal combustion engine installed in the vehicle together with the valve timing adjuster 1. The correlation information is stored in the memory 36*a* (serving as a storage device) and is used to compute the period ω of cycle of the change in the variable torque at the control circuit 36 (serving as a computing device). Alternatively, the period ω of cycle of the change in the variable torque may be learned from the output of the cam angle sensor 7 and the output of the crank angle sensor 8, and the correlation information stored in the memory 36*a* may be updated regularly based on the result of the learning.

Figure 8D:
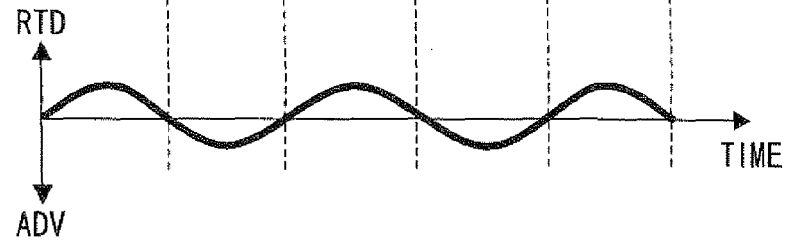

When the rotational torque, which periodically changes at the same period of cycle but the opposite phase of cycle with respect to the variable torque, is generated by alternately repeating the advancing supply and the retarding supply, the torque of the opposite phase, which effectively counteracts against the variable torque, is applied to the vane rotor 14 and the camshaft 2. Thus, even under the influence of the relatively large variable torque, such a variable torque can be damped or canceled with the rotational torque to reduce the volume change of the respective chambers 51-53, 55-57. Therefore, it is possible to limit the fluctuating movement (oscillating rotational movement) of the vane rotor 14 relative to the housing 18 that likely causes the change in the engine phase, as shown in FIG. 8D.

As described above, according to the first embodiment, the actual phase Pr is appropriately limited within the target phase range ΔPt, and the valve timing is adjusted to the appropriate timing, which is appropriate for the internal combustion engine. Furthermore, the hammering sound, which is caused by the collision between the housing 18 and the vane rotor 14, can be advantageously limited.

Second Embodiment

A second embodiment of the present invention, which is a modification of the first embodiment, will be described with reference to FIG. 9.

Figure 9:
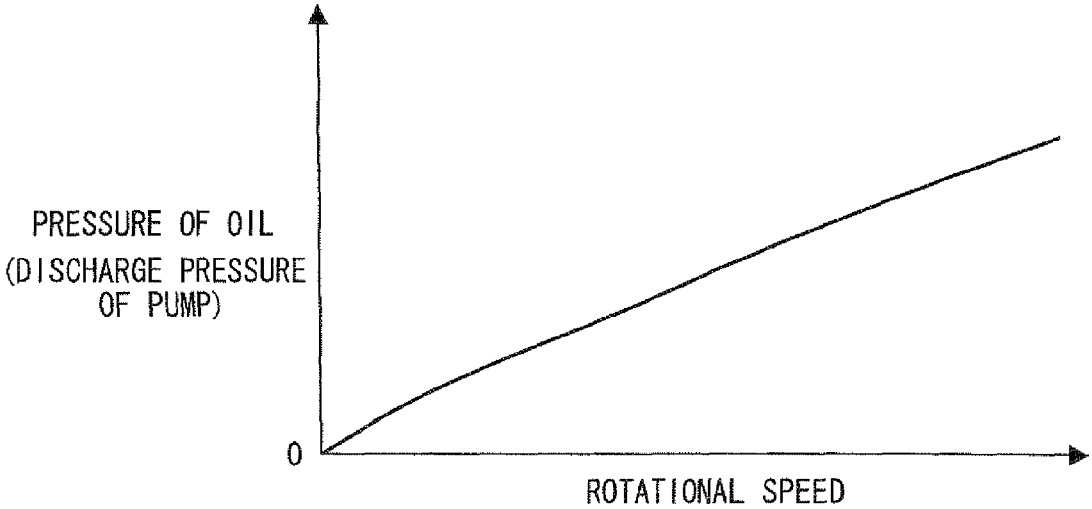
FIG. 9 is a diagram for describing characteristics of a valve timing adjuster according to a second embodiment of the present invention.

As shown in FIG. 9, the discharge pressure of the oil at the oil pump 4 driven by the internal combustion engine, i.e., the pressure of the oil supplied to the advancing chambers 51-53 and the retarding chambers 55-57 is increased in response to an increase in the rotational speed of the internal combustion engine. Also, the pressure of the oil changes depending on the environmental temperature.

Therefore, according to the second embodiment, the alternately repeating supply operation, which is similar to that of the first embodiment, is executed in the case where the stable condition (serving as the limiting condition) is satisfied, and the pressure of the oil becomes equal to or less than the preset value S. Thereby, in the low oil pressure state where the pressure of the oil is equal to or less than the preset value S, it is possible to reliably limit the fluctuating movement of the vane rotor 14, which tends to occur in the low oil pressure state.

Thus, when the pressure of the oil is larger than the preset value S (e.g., about 250 kPa), occurrence of the fluctuating movement of the vane rotor 14 becomes less in comparison to the case where the pressure of the oil is equal to or less than the preset value S. Therefore, in such a case, according to the present embodiment, the normal operation is executed without executing the alternately repeating supply operation. In the normal operation, the drive current to the switch control valve 31 is controlled in the manner similar to that of the retarding operation described above to supply the oil to the respective advancing chambers 51-53, so that the rotational torque in the advancing direction X is generated against the average variable torque Tca. At this time, the drive current supplied to the switch control valve 31 is adjusted in the range less than the reference value Ib to limit the actual phase Pr within the target phase range ΔPt, so that the current valve timing is maintained.

The present invention has been described with respect to the above embodiments. However, the present invention is not limited to the above embodiments, and the above embodiments may be modified within a spirit and scope of the present invention.

For example, in the first and second embodiments, it is possible to provide a resilient member (e.g., an assist spring), which urges the camshaft 2 in the direction opposite from that of the average variable torque Tca. Even in such a case where the resilient member is provided, the fluctuating movement of the vane rotor 14 can be limited by alternately repeating the advancing supply and the retarding supply.

In addition, in the first and second embodiments, the housing 18 is rotated together with the crankshaft, and the vane rotor 14 is rotated together with the camshaft 2. However, the present invention is also applicable to a valve timing adjuster, in which the vane rotor 14 is rotated together with the crankshaft, and the housing 18 is rotated together with the camshaft 2.

Furthermore, in the first and second embodiments, the present invention is applied to the valve timing adjuster, which controls the valve timing of the intake valves. Alternatively, the present invention may be applied to a system, which controls valve timing of intake valves, or a system, which controls the valve timing of both of the intake valves and the exhaust valves.

Additional advantages and modifications will readily occur to those skilled in the art. The invention in its broader terms is therefore not limited to the specific details, representative apparatus, and illustrative examples shown and described.

What is claimed is:

1. A valve timing adjuster that adjusts opening and closing timing of at least one of an intake valve and an exhaust valve of an internal combustion engine and is placed in a drive force transmission system, which transmits a drive force from a drive shaft of the internal combustion engine to a driven shaft that drives the at least one of the intake valve and the exhaust valve to open and close the same, the valve timing adjuster comprising:

a first rotatable body that is rotated together with the drive shaft;

a second rotatable body that is rotated together with the driven shaft, wherein the second rotatable body cooperates with the first rotatable body to form an advancing chamber and a retarding chamber, which are arranged one after another in a rotational direction between the first rotatable body and the second rotatable body, and the second rotatable body generates a rotational torque that drives the driven shaft in an advancing direction or a retarding direction relative to the drive shaft upon supplying of working fluid to the advancing chamber or the retarding chamber; and a supply control means for controlling advancing supply, which is supply of the working fluid to the advancing chamber, and retarding supply, which is supply of the working fluid to the retarding chamber, wherein the supply control means alternately and repeatedly executes the advancing supply and the retarding supply in such a manner that the rotational torque changes at a phase of cycle that is opposite from a phase of cycle of a variable torque, which changes with time and is applied to the driven shaft, at time of limiting a phase of the driven shaft relative to the drive shaft within a target phase range.

2. The valve timing adjuster according to claim 1, wherein the supply control means alternately and repeatedly executes the advancing supply and the retarding supply in a manner that causes generation the rotational torque, which changes at the phase of cycle that is opposite from the phase of cycle of the variable torque, while maintaining generally the same period of cycle, which is generally the same as a period of cycle of the variable torque.

3. The valve timing adjuster according to claim 2, wherein the supply control means includes:

a storage device that stores correlation information, which indicates relationship between a rotational speed of the internal combustion engine and the period of cycle of the variable torque; and a computing device that computes the period of cycle of the variable torque that corresponds to an actual rotational speed of the internal combustion engine based on the correlation information stored in the storage device.

4. The valve timing adjuster according to claim 1, wherein the supply control means alternately and repeatedly executes the advancing supply and the retarding supply upon satisfaction of the following conditions:

a limiting condition for limiting the phase of the driven shaft relative to the drive shaft within the target phase range is satisfied; and a pressure of the working fluid, which is supplied to the advancing chamber and the retarding chamber, is equal to or less than a preset value.

* * * * *